US006749229B2

(12) United States Patent
Kennedy

(10) Patent No.: US 6,749,229 B2
(45) Date of Patent: Jun. 15, 2004

(54) MACHINE INSERTABLE PROMOTIONAL CARD

(75) Inventor: Michael R. Kennedy, Gates Mills, OH (US)

(73) Assignee: Rock Ridge Technologies, Co., Willoughby, OH (US)

( * ) Notice: Subject to any disclaimer, the term of this patent is extended or adjusted under 35 U.S.C. 154(b) by 0 days.

(21) Appl. No.: 10/225,679

(22) Filed: Aug. 22, 2002

(65) Prior Publication Data

US 2004/0036271 A1 Feb. 26, 2004

(51) Int. Cl.[7] ..... B42D 15/00

(52) U.S. Cl. ..... 283/56; 40/124.08; 40/606; 206/232; 281/3.1; 283/61; 283/63.1; 283/101; 283/107

(58) Field of Search ..... 283/56, 61, 62, 283/63.1, 64, 81, 101; 206/232; 40/124.08, 124.16, 606; 281/2, 3.1, 5

(56) References Cited

U.S. PATENT DOCUMENTS

| | | | | | |
|---|---|---|---|---|---|
| 3,807,771 | A | * | 4/1974 | Greason | 283/56 |
| 3,819,173 | A | * | 6/1974 | Anderson et al. | 270/52.04 |
| 3,982,746 | A | | 9/1976 | O'Brien et al. | |
| 3,995,555 | A | | 12/1976 | Stewart | |
| 4,149,711 | A | * | 4/1979 | Jackson | 270/1.02 |
| 4,285,520 | A | * | 8/1981 | Small | 273/240 |
| 4,643,451 | A | | 2/1987 | Coates | |
| 4,941,574 | A | * | 7/1990 | Meehan | 206/466 |
| 4,967,951 | A | | 11/1990 | Sherman | |
| 5,021,274 | A | | 6/1991 | Beck et al. | |
| 5,127,676 | A | | 7/1992 | Bockairo | |
| 5,197,599 | A | * | 3/1993 | Dolan | 206/232 |
| 5,228,692 | A | * | 7/1993 | Carrick et al. | 273/139 |
| 5,228,723 | A | * | 7/1993 | Hertig | 283/100 |
| 5,255,456 | A | * | 10/1993 | Franklin | 40/124.191 |
| 5,290,616 | A | | 3/1994 | Cowan et al. | |
| 5,308,120 | A | | 5/1994 | Thompson | |
| 5,439,721 | A | | 8/1995 | Pedroli et al. | |
| 5,490,692 | A | * | 2/1996 | Howard | 283/81 |
| 5,501,491 | A | * | 3/1996 | Thompson | 283/70 |
| 5,587,222 | A | | 12/1996 | Hoffmann | |
| 5,700,537 | A | | 12/1997 | Instance | |
| 5,727,817 | A | | 3/1998 | Kraige | |
| 5,776,586 | A | * | 7/1998 | Lipper | 428/195 |
| 5,804,271 | A | | 9/1998 | Barry | |
| 5,830,550 | A | | 11/1998 | Treleaven et al. | |
| 5,846,623 | A | | 12/1998 | Denny | |
| 5,953,885 | A | * | 9/1999 | Berman et al. | 53/431 |
| 6,006,669 | A | | 12/1999 | Klein et al. | |
| 6,027,780 | A | | 2/2000 | Treleaven et al. | |
| 6,092,847 | A | | 7/2000 | Best et al. | |
| 6,270,121 | B1 | | 8/2001 | Dolan et al. | |
| 6,301,860 | B1 | * | 10/2001 | Gunderman et al. | 53/410 |
| 6,329,034 | B1 | * | 12/2001 | Pendry et al. | 428/40.1 |

FOREIGN PATENT DOCUMENTS

| | | | |
|---|---|---|---|
| DE | 19812232 | * | 12/1998 |
| FR | 2767597 | * | 2/1999 |

* cited by examiner

*Primary Examiner*—Monica S. Carter
(74) *Attorney, Agent, or Firm*—Pearne & Gordon LLP

(57) ABSTRACT

A promotional card including a base card defining front and rear surfaces with at least one of the surfaces having indicia thereon and a token attached to at least one of the surfaces of the base card. In one example, the token is an informational booklet that is removably attached to the base card. An overlaminate is disposed over at least a portion of the informational booklet, the overlaminate includes at least one weakened region between the informational booklet and at least one of the top and bottom edges of the base card. The informational booklet is attached to at least one of the surfaces of the base card and contains at least one non-adhered edge and at least one adhered edge with the adhered edge being the leading edge for feeding the promotional card into a high speed processing machine that will feed the promotional card into a multi-page article.

33 Claims, 3 Drawing Sheets

MACHINE INSERTABLE PROMOTIONAL CARD

BACKGROUND OF THE INVENTION

1. Field of the Invention

This invention relates generally to promotional materials, such as those inserted into a multi-page newspaper, magazine or the like, hereinafter referred to as multi-page articles, for supplying informational material to the reader, and more particularly, to a promotional card that is provided with an informational booklet or the like removably or permanently adhered to a face of the promotional card such that the card may be inserted by a high speed insertion process into a machine that inserts the card into a multi-page article.

1. Description of the Related Art

It is common in the art to provide promotional adhesive labels to products or containers for products. The label is adhered to the product or container an included leaflet is accessed by peeling away a cover sheet. The attachment of a leaflet may be used on many products for informational reasons such as relating to warranties, operational instructions, label requirements, or other matters.

U.S. Pat. No. 5,127,676 to Bockairo discloses an adhesive label having a folded leaflet, coupon or the like disposed between a base sheet and a cover sheet. The cover sheet is wider than the folded leaflet, having side edges peelably adhered to the base sheet. The cover sheet has at least one edge extending outwardly beyond the ends of the sides edges so as to form tabs which are readily grasped for peeling away the cover sheet for access to the leaflet. The label is disclosed in circular and rectangular embodiments. The end areas of the cover sheet side edges may be tapered to reduce the possibility of tearing the cover sheet.

U.S. Pat. No. 5,290,616 to Cowan et al. discloses a resealable, overlaminated leaflet label having a folded leaflet overlaid by a cover sheet having opposed marginal portions extending beyond the edges of the leaflet. The undersurface of the cover sheet is coated with peelable adhesive material such that the marginal portions are peelably adhered to the surface of an article with the leaflet disposed between the article and the cover sheet.

U.S. Pat. No. 6,270,121 to Dolan et al. discloses a brochure assembly with a product information patch removably attached to one of the panels. The product information patch includes a base label secured to the primary brochure, a folded product information sheet positioned centrally on the base label and an overlaminate secured over the folded product information sheet and the base label.

There is an unmet need in the art for a promotional card having an easily removable informational booklet with adhered edges that allow the promotional card to be inserted into a machine that places the promotional card into multi-page articles at high insertion speeds. Preferably, such a machine can insert such promotional cards at high speed into the traveling web of a printing process for multi-page articles such as magazines, newspapers, etc.

SUMMARY OF THE INVENTION

Provided is a folded leaflet attached to a promotional card that is suitable to be machine inserted at high processing speeds into a multi-page article. The informational leaflet or booklet is attached by adhered edges and is able to withstand the tension forces associated with a high speed machine insertion process.

The present invention provides a promotional card that is machine insertable in a multi-page article for use in supplying informational material to a reader. The promotional card comprises a base card defining front and rear surfaces with at least one of the surfaces having indicia thereon. An informational booklet is removably attached to at least one of the surfaces of the base card and means are provided for adhering the informational booklet to at least one of the surfaces of the base card.

The informational booklet is machine insertable into the mutli-page article with the informational booklet attached into a position that allows the informational booklet to be easily severed from the base card by the reader.

In addition, a method of providing a promotional card as an insert in a multi-page article is provided. The method includes providing a base card defining front and rear surfaces with at least one of the surfaces having indicia thereon. The method further includes attaching an informational booklet to at least one of the surfaces of the base card. The informational booklet contains at least one adhered edge with the adhered edge being the leading edge for feeding the promotional card into the inserting machine for machine inserting the promotional cards into multi-page articles.

The promotional card is then oriented into the machine such that the informational booklet containing at least one adhered edge is the leading edge for feeding the promotional card into the machine. Finally, using high speed feeding apparatus the promotional cards are fed (inserted) from the inserting machine into the multi-page articles.

It is one aspect of this invention to provide a manner in which an informational booklet can be attached to the base card by an adhered edge and that the adhered edge can withstand the tension forces associated with the high speed machine feeding of the promotional cards for placement of the cards into multi-page articles.

These and other aspects of this invention are illustrated in the accompanying drawings, and are more fully disclosed in the following specification.

DESCRIPTION OF EXAMPLE EMBODIMENTS OF THE INVENTION

As used herein, the term token refers generally to any item that is secured or attached to a base card for insertion into a multi-page article as hereinafter described. A token can be, for example, an informational leaflet, a multi-page booklet, a card, paper or any other medium or substrate having pre-printed material or information or indicia thereon, a game piece, coin, swatch, collectible card, etc. In the description that follows, the token is most preferably an informational leaflet or booklet 30 as shown in the figures and referred to herein. However, it is to be understood that reference to an informational leaflet or booklet herein is not intended to limit the scope of the invention, and that any of the above tokens, as well as others not listed, can be substituted for the leaflet or booklet.

Figure 1:
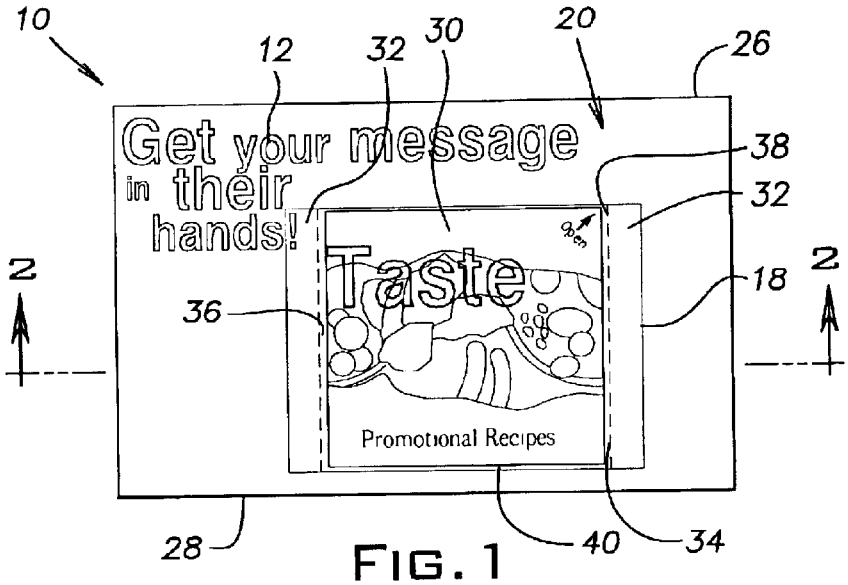
FIG. 1 is a plan view of an exemplary promotional card in accordance with the present invention.
Figure 2:
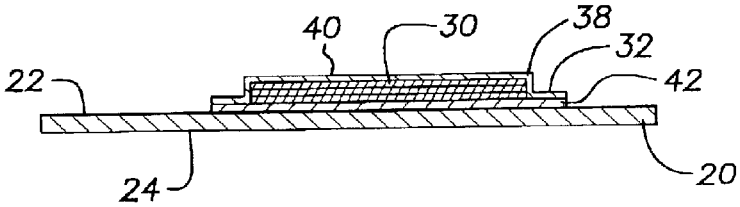
FIG. 2 is a cross-sectional view taken along line 2—2 in FIG. 1.

A promotional card 10 in accordance with the subject invention is illustrated in FIGS. 1 and 2. The promotional card may contain indicia 12 on a base card 20 and also on the attached informational booklet or leaflet 30. The indicia 12 on the base card 20 and leaflet 30 can cooperate to present an innovative ad campaign to the reader or some other valuable material such as coupons, recipes, etc.

The base card 20 has a front surface 22 (FIG. 2) and a rear surface 24 (FIG. 2) with at least one of the surfaces or both surfaces having the indicia 12 (FIG. 1) thereon. The base card has a top edge 26 and a bottom edge 28 (FIG. 1). It is to be appreciated that the description herein with regard to direction and orientation are merely for ease in understanding the described example as shown in the drawings.

The base card, for example, may be configured to dimensions that measure five and one-half inches in length and three and one-half inches in width, or typical post card dimensions. The size of the base card 20 is not limited in the present invention and other sizes of the base card 20 may also be used.

Figure 1A:
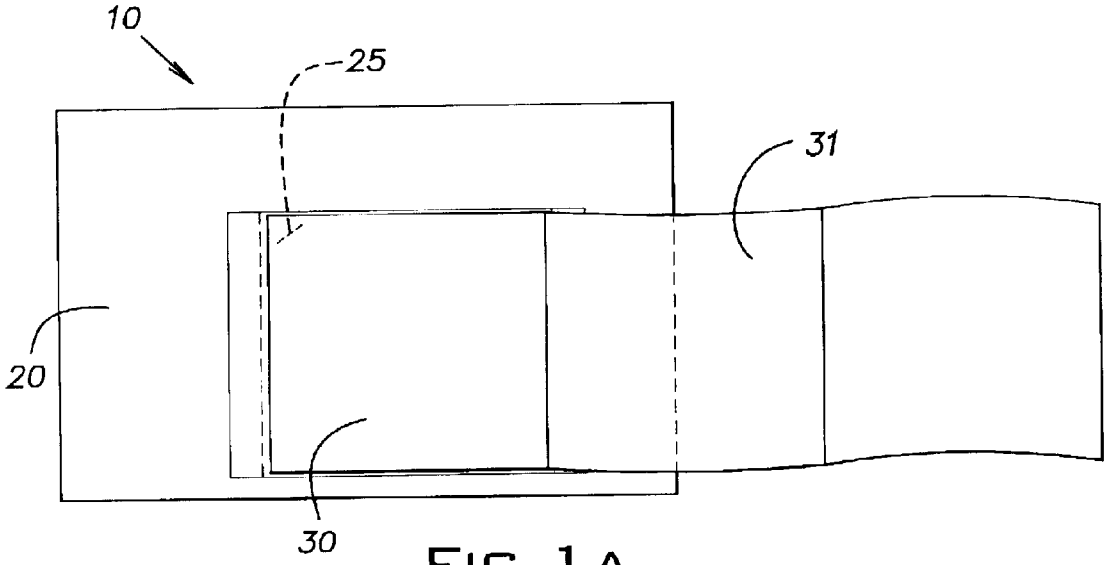
FIG. 1A is a plan view showing the informational leaflet folded out.

In one example, the informational leaflet 30 is removably attached to one of the surfaces (e.g. front surface 22) of the base card 20. The informational leaflet 30 may contain multiple pages that become a foldout 31 (FIG. 1A) from the base card 20. The informational leaflet 30 may be folded to a size substantially smaller that the size of the base card to which the informational leaflet is adhered. Promotional card 10 includes means for adhering the informational booklet 30 to the surface of the base card 20. The top and bottom edges 26, 28 of the base card may be spaced from the edges of the informational leaflet 30 by, for example, at least 0.25 of an inch.

The means for adhering or attaching the informational leaflet 30 to the base card 20 may include an adhesive overlaminate 40 (FIG. 2) disposed over at least a portion of the informational leaflet 30. It is to be noted that the vertical dimensions shown in FIG. 2 are exaggerated for ease of illustration. The informational leaflet 30 may also be attached to the base card 20 by other types of attachment means. These means may include mechanical fasteners, for example a staple 25 (shown in phantom in FIG. 1A), or adhesives that directly bond the informational leaflet 30 to the base card 20.

In one specific example, the attachment means include at least one weakened region 36 (FIG. 1) adjacent to a junction 34 between an edge of the informational leaflet 30 and the base card 20. In the illustrated example, two weakened regions 36 are provided. As used herein the term weakened region refers to any means, such as a designed or intended failure mode, by which the attachment means is or can be at least partially intentionally disengaged or removed by a consumer such that the leaflet 30 is exposed or readily accessible or at least partially removable by the consumer. In one example, each weakened region 36 includes an array of perforations 38 in the overlaminate 40 as shown in FIG. 1. In another example, the weakened region 36 can include scoring the overlaminate 40 such that the overlaminate will tear along a scored line thereby exposing the underlying leaflet 30.

An overlaminate base 42 (FIG. 2) optionally may be provided. For such an arrangement adhered edges 32 of the overlaminate 40 may be adhered to the overlaminate base 42. The overlaminate base 42 may also be excluded as the overlaminate 40 may be attached directly to the informational leaflet 30 and to the base card 20.

The overlaminate 40 may include a transparent material so that the indicia on the cover of the informational leaflet 30, the surrounding portion of the base card 20, and the coordinated innovative ad campaign thereby, are not hidden by the overlaminate 40. Also in one example, the top and or bottom edges of the booklet are not covered by the overlaminate 40 for example. Specifically, in the example, the overlaminate 40 has a height that is not greater that the height of the leaflet 30. In a further alternative embodiment the overlaminate 40 can be co-extensive with the base card 20.

As mentioned, the informational leaflet 30 can be accessed easily by means to permit easy or at least partial detachment of the informational booklet from the base card by the reader. The informational leaflet 30 and the overlaminate 40 may be detached by pulling them away from the base card 20. Means for detachment include the open top and/or bottom edge of the leaflet 30. A pulling force on the informational leaflet 30 and the overlaminate 40 causes a tearing of the overlaminate 40 along one or more weakened regions 36 (e.g., arrays of perforations 38). The overlaminate base 42, if present, and regions of the overlaminate 40 at the adhered edges 32 remain on the base card 20. As such, the informational leaflet 30 is at least partially detached from the base card 20. Complete detachment of the booklet is also contemplated.

The remaining portions of the overlaminate 40 provide no adhesive residue that affects continued use and storage of the informational leaflet 30. In addition, the overlaminate base 42 may be transparent (or white or colored), and the transparency of the overlaminate base 42 and the overlaminate 40 will not adversely affect the viability (e.g., readability) of the base card 20 after removal of the informational leaflet 30 and central portions of the overlaminate 40.

Figure 3:
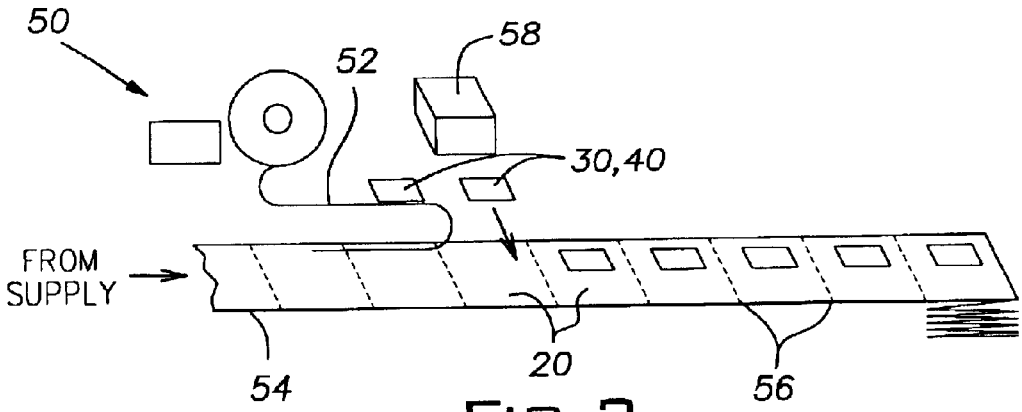
FIG. 3 is a of a partial schematic view of labeling machine that applies informational leaflets to the base cards.

The informational leaflet 30 and overlaminate 40 may be placed on the base card 20 (FIG. 1), as shown in FIG. 3, by an automated machine 50, for example a labeling machine as known in the art and shown schematically in FIG. 3. However, it is to be appreciated that the leaflet 30 and overlaminate 40 can be placed on the base card 20 via any other suitable means. Turning to the machine 50, a plurality of informational leaflets 30 with overlaminates 40 are supplied preassembled on a carrier web 52, as conventional in the art, to the machine 50. A plurality of base cards 20 are also supplied to the machine 50, preferably as a web 54 as also conventional in the art. The machine 50 includes means 58 (schematically shown) that applies an informational booklet preassembly (which includes leaflet 30 and overlaminate 40) to each base card 20 from web 54. This process is depicted schematically in FIG. 3. Machines 50 (for example as disclosed in U.S. Pat. No. 6,006,669, hereby incorporated by reference) as well as the operation thereof, are known or conventional in the art. Therefore, the machine 50 will not be further described.

Figure 4:
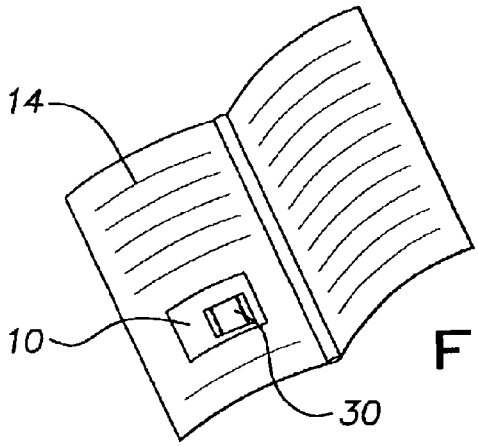
FIG. 4 is a perspective view of the promotional card shown in FIG. 1 inserted into a multi-page article.

As each informational leaflet 30 with overlaminate 40 is attached to the associated base card 20, the result upon exiting the machine 50 is a web 54 of promotional cards 10 according to the invention. The promotional cards 10 can be separated from one another, for example via perforations 56, and arranged in a stack for subsequent machine insertion into multi-page articles 14, for example as shown in FIG. 4. Alternatively, the promotional cards 10 can be maintained in the web 54 and configured as a roll, fanfold, or other suitable configuration depending on the nature and requirements of the inserting machine that will insert the cards 10 into multi-page articles 14.

Referring now to FIG. 4, the promotional cards 10 (each comprising an informational leaflet 30 and overlaminate 40 attached to a base card 10) are machine inserted into multi-page articles 14 into a position that allows the promotional card 10 to be easily found by the reader. This allows the reader to quickly view and enjoy the indicia located on the attached promotional card 10 and the innovative ad campaign produced by the promotional card 10. The article 14 may be a newspaper, a magazine, or the like.

Figure 5:
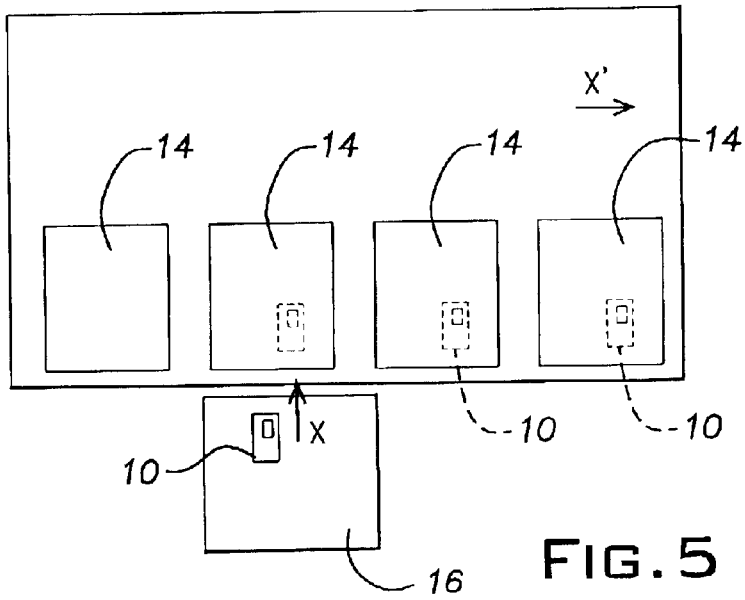
FIG. 5 is a plan schematic view of a machine that inserts the promotional card into the multi-page article.

As illustrated in FIG. 5, an inserting machine 16 may be used to insert the promotional card 10 into article 14 using high speed feeding apparatus. Preferably, promotional cards 10 are fed in direction X as shown in FIG. 5 on machine 16 while the articles 14 travel in direction X'. In a preferred embodiment, the inserting machine 16 can also be a labeling machine or other similar machine as known in the art, preferably a machine as described in U.S. Pat. No. 6,006,669 referenced and incorporated above. As such, the process of preparing and inserting the promotional cards 10 according to the invention into multi-page articles 14 can be thought of essentially as a two-step process; first the leaflet 30 and overlaminate 40 are attached to the base card 20 to form the promotional card 10, and second the promotional card 10 is then attached to a page of the multi-page article 14. These two steps can be performed together as different stages of the same manufacturing process. More preferably, the promotional cards 10 are separately prepared, and delivered fully assembled to the printer of the multi-page articles 14 for insertion therein, preferably at high speed during the printing process for the articles 14.

Figure 6:
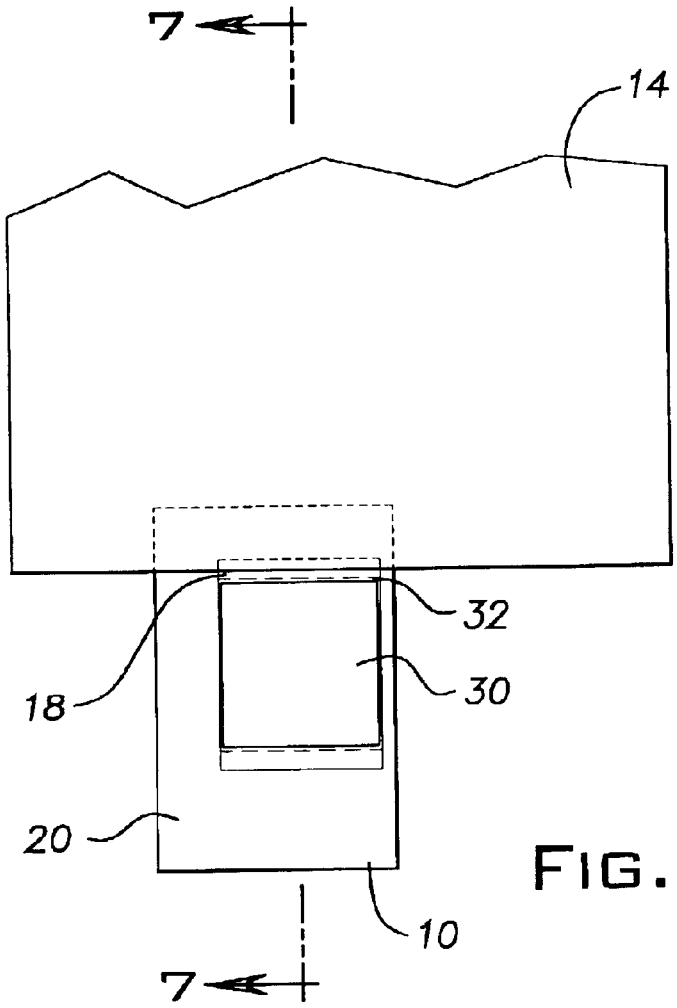
FIG. 6 is partial plan view of the leading edge of the promotional card being inserted into the multi-page article.
Figure 7:
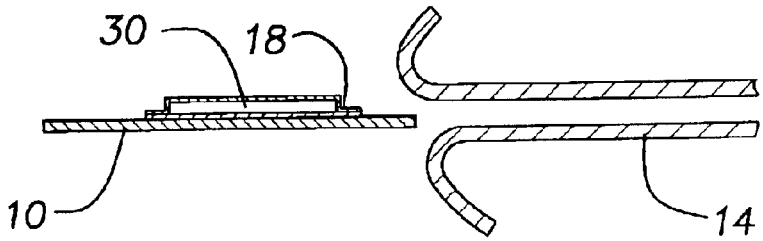
FIG. 7 is a cross-sectional view taken along line 7—7 in FIG. 6.

As shown in FIGS. 6 and 7, the manner in which the informational leaflet 30 is attached by the adhered edge 32 to the base card 20 must be able to withstand the tension forces associated with the high speed inserting machine 16 (FIG. 5), feeding the promotional cards 10 into the multi-page articles 14. The base card 20 may be oriented in the machine such that the informational booklet containing the adhered edge is a leading edge 18 (FIG. 7) for feeding the promotional card 10 into the article.

Also, it is contemplated that the promotional card 10 remains secured within the multi-page article 14 via friction from the pages that lie against the promotional card. Alternatively, a tack or glue strip could be applied to the promotional card 10 such that the strip will adhere to a page within the multi-page article 14.

A method of providing a promotional card 10 as an insert into the multi-page article 14 is also disclosed. Base cards 20 of varying sizes may be provided with front 22 and rear 24 surfaces, at least one of the surfaces having indicia 12 thereon.

An informational leaflet 30 may be attached to the base card 20 to at least one of the surfaces of the base card 20, the informational leaflet 30 containing at least one non-adhered edge and at least one adhered edge 32 with the adhered edge being the leading edge 18 for feeding the promotional card 10 into the machine (see FIG. 6). Alternatively, the leaflet 30 can be adhered to the base card 20 on all sides, i.e. around the entire perimeter of the leaflet 30. When an overlaminate 40 is used as the attachment means, the overlaminate 40 may be adhered to the base card 20 around the entire perimeter of the leaflet 30, or alternatively the overlaminate 40 can be adhered to the base card 20 adjacent at least one edge of the leaflet 30 (for example adjacent two edges of the leaflet 30 as shown in FIG. 1). The base card 20 may then be oriented in inserting machine 16 such that the adhered edge 32 of leaflet 30 is the leading edge 18 for feeding the promotional cards 10 into and through the machine 16. When the leaflet 30 is adhered to the base card 20 on all sides, the leaflet 30 can be inserted into the multi-page article 14 in any desired orientation because the leading edge 18 will always be an adhered edge 32. The machine 16 may use high speed feeding apparatus to feed the promotional cards 10 from the machine into multi-page articles 14.

The invention as described and illustrated provides several advantages. In particular, the complex and costly process of manually placing the informational leaflet 30 on a base card 20 is automated by the use of a labeling machine 50. In addition, the manual costs associated with the manual insertion of the promotional card 10 in the article 14 are also reduced by the ability of the promotional card to be automatically inserted into an article by high speed handling equipment such as inserting machine 16. Preferably, the inserting machine 16 is operated at such a speed as to insert at least 40,000, preferably 50,000, preferably 60,000, preferably 70,000, preferably 80,000, preferably 90,000, preferably 100,000, promotional cards per hour into multi-page articles with an accuracy of at least 70, preferably at least 80, preferably at least 90, preferably at least 95, percent. Accuracy refers to the percentage of attempted machine insertions of the promotional cards 10 into multi-page articles 14 are successfully completed, with the promotional card properly and securely positioned on the desired page of the multi-page article.

Although the invention has been shown and described with respect to certain embodiments, it is obvious that equivalent alterations and modifications will occur to others skilled in the art upon reading and understanding the specification. The present invention includes all such equivalent alterations as fall within the scope and spirit of the appended claims.

What is claimed is:

1. A promotional card comprising:

a base card having a front surface and a rear surface;

an informational leaflet attached to at least one of said front surface end said rear surface of the base card; and means for attaching the informational leaflet to the base card;

said base card being non-adhesively machine insertable into a multi-page article in between adjacent pages thereof, wherein the base card, the informational leaflet, and the attachment means are arranged and cooperate to permit the promotional card to be non-adhesively machine inserted into the multi-page article in between adjacent pages thereof such that the informational leaflet does not become detached from the base card during machine insertion of the promotional card into said multi-page article.

2. A promotional card according to claim 1, said informational leaflet being a multi-page booklet.

3. A promotional card according to claim 1, said informational leaflet being removably attached to said base card.

4. A promotional card according to claim 1, said attachment means comprising an overlaminate disposed over at least a portion of the informational leaflet.

5. A promotional card according to claim 4, said overlaminate being substantially transparent.

6. A promotional card according to claim 1, said attachment means comprising a mechanical fastener.

7. A promotional card according to claim 1, said base card having indicia printed on at least one of said front surface and said rear surface thereof.

8. A promotional card according to claim 1, wherein the token informational leaflet has dimensions smaller than those of the base card to which the attached.

9. A promotional card according to claim 1, wherein the informational leaflet comprises a multi-sheet leaflet with at least one foldout section.

10. A promotional card according to claim 9, wherein the attachment means include an overlaminate disposed over at least a portion of the multi-sheet leaflet, the overlaminate including at least one weakened region adjacent a junction of an edge of the multi-sheet leaflet and the base card.

11. A promotional card according to claim 1, said attachment means including at least one weakened region.

12. A promotional card according to claim 1, said attachment means being disposed between the informational leaflet and the base card.

13. A promotional card according to claim 1, said attachment means comprising en adhesive.

14. A promotional card according to claim 1, further comprising an overlaminate attached to the informational leaflet and the base card.

15. A promotional card according to claim 1, said leaflet having at least one adhered edge, said adhered edge being adhered to said base card, said adhered edge being a leading edge of said leaflet for feeding the promotional card into and through an inserting machine for inserting the promotional card into said multi-page article.

16. A promotional card according to claim 15, said leaflet being adhered to said base card around the entire perimeter of said leaflet.

17. A promotional card according to claim 1, said informational leaflet being in the form of a card.

18. A promotional card according to claim 1, said informational leaflet being one page.

19. A promotional card comprising:

a base card having a front surface and a rear surface;

an informational leaflet attached to at least one of said front surface and said rear surface of the base card; and means for attaching the informational leaflet to the base card;

said base card being machine insertable into a multi-page article in between adjacent pages thereof, wherein the base card, the informational leaflet, and the attachment means are arranged and cooperate to permit the promotional card to be machine inserted into the multi-page article in between adjacent pages thereof such that the token informational leaflet does not become detached from the base card during machine insertion of the promotional card into said multi-page article, the attachment means having at least one adhered edge, said adhered edge being adhered to said base card, said adhered edge being a leading edge of said attachment means for inserting the promotional card into said multi-page article.

20. A promotional card according to claim 19, said attachment means being adhered to said base card around the entire perimeter of said leaflet.

21. A promotional card comprising:

a base card having a front surface and a rear surface;

a token attached to at least one of said front surface and said rear surface of the means for attaching the token to the base card;

said base card being non-adhesively machine insertable into a multi-page article in between adjacent pages thereof, wherein the base card, the token, and the attachment means are arranged and cooperate to permit the promotional card to be non-adhesively machine inserted into the multi-page article in between adjacent pages thereof such that the token does not become detached from the base card during machine insertion of the promotional card into said multi-page article, said attachment means comprising an overlaminate having at least one weakened region including an array of perforations in said overlaminate.

22. A promotional card comprising:

a base card having a front surface and a rear surface;

a token attached to at least one of said front surface and said rear surface of the base card; and means for attaching the token to the base card;

said base card being non-adhesively machine insertable into a multi-page article in between adjacent pages thereof, wherein the base card, the token, and the attachment means are arranged and cooperate to permit the promotional card to be non-adhesively machine inserted into the multi-page article in between adjacent pages thereof such that the token does not become detached from the base card during machine insertion of the promotional card into said multi-page article, said attachment means comprising an overlaminate having a weakened region including scoring the overlaminate to form a scored line therein.

23. A promotional card that is machine insertable into a multi-page article, the promotional card comprising:

a base card having a front surface and a rear surface, at least one of said surfaces having indicia thereon; and an informational leaflet attached to at least one of said surfaces of said base card via an overlaminate, the overlaminate having at least one adhered edge adhered to said base card, said adhered edge being a leading edge of said overlaminate for feeding the promotional card into an inserting machine, said promotional card thus being adapted to be non-adhesively machine inserted into said multi-page article in between adjacent pages thereof such that the informational leaflet is not prone to detachment from the base card as a result of machine insertion of the promotional card into said multi-page article.

24. A promotional card according to claim 23, said informational leaflet being a multi-sheet leaflet having at least one fold out section.

25. A promotional card according to claim 23, said informational leaflet being a multi-page booklet.

26. A promotional card according to claim 23 said overlaminate being adhered to said base card around the entire perimeter of said leaflet.

27. A method of providing a promotional card as an insert in a multi-page article, the method comprising the steps of:

providing a base card having a front surface and a rear surface;

attaching a informational leaflet to at least one of said front surface and said rear surface of said base card via an attachment means to form a promotional card, the attachment means comprising at least one adhered edge being adhered to said base card;

orienting said promotional card in an inserting machine such that said adhered edge of said attachment means is a leading edge of said attachment means for feeding the promotional card in between adjacent pages of said multi-page article by said inserting machine; and operating said inserting machine to feed the promotional card from said machine in between adjacent pages of the multi-page article, said promotional card being thereby non-adhesively disposed in said multi-page article between adjacent pages thereof.

28. A method according to claim 27, said attachment means being an overlaminate disposed over at least a portion of the informational leaflet.

29. A method according to claim 28, wherein said overlaminate is provided being adhered to said base card around the entire perimeter of said token informational leaflet.

30. A method according to claim 27, said informational leaflet being adhered to said base card around the entire perimeter of thereof.

31. A method according to claim 27, wherein said token informational leaflet does not become detached from said base card during machine insertion of said promotional card into said multi-page article.

32. A method according to claim 27, wherein said inserting machine is operated at a rate inserting at least 40,000 promotional cards per hour into multi-page articles with an accuracy of at least 70 percent.

33. A method of inserting a promotional card into a multi-page article comprising the steps of:

providing a base card having a front surface and a rear surface;

attaching a token to at least one of said front and rear surfaces of said base card via an attachment means to form a promotional card, the attachment means comprising at least one adhered edge being adhered to said base card;

conveying a multi-page article along a conveyance path in a first direction of travel;

positioning said promotional card adjacent to and substantially coplanar with said conveyance path of said multi-page article;

orienting said promotional card such that said adhered edge of said attachment means is oriented toward said multi-page article along a second direction of travel that is substantially perpendicular to, and substantially coplanar with, said conveyance path of said multi-page article; and conveying said promotional card along said second direction of travel to thereby insert said promotional card in between adjacent pages of said multi-page article while said multi-page article is being conveyed in said first direction of travel, said promotional card being thereby non-adhesively disposed within said multi-page article in between adjacent pages thereof.

* * * * *

UNITED STATES PATENT AND TRADEMARK OFFICE

CERTIFICATE OF CORRECTION

PATENT NO. : 6,749,229 B2
DATED : June 15, 2004
INVENTOR(S) : Michael R. Kennedy It is certified that error appears in the above-identified patent and that said Letters Patent is hereby corrected as shown below:

Column 7,
Line 26, please delete “en” and insert therefor -- an --.

Column 8,
Line 4, please delete “means for attaching the token to the base card;” and insert therefor -- base card; and --.
Line 5, after “the base card;” please insert on a new line -- means for attaching the token to the base card; --.

Column 9,
Line 24, please delete “of”.
Line 25, please delete “token”.

Signed and Sealed this

Twenty-first Day of December, 2004

JON W. DUDAS
*Director of the United States Patent and Trademark Office*